US006278069B1

(12) United States Patent
Lee et al.

(10) Patent No.: US 6,278,069 B1
(45) Date of Patent: Aug. 21, 2001

(54) APPARATUS AND METHOD FOR SUPPLYING POWER TO AN ELECTRONIC SYSTEM

(75) Inventors: Ji-Young Lee, Ahnyang; Sung-Sik Park, Seoul; Ki-Seon Kim, Suwon, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/718,396

(22) Filed: Nov. 24, 2000

(30) Foreign Application Priority Data

Nov. 23, 1999 (KR) ..... 99-52233

(51) Int. Cl.[7] ..... H01H 15/00
(52) U.S. Cl. ..... 200/16 C; 323/350; 200/18
(58) Field of Search ..... 200/16 C, 18, 200/517; 323/350

(56) References Cited

U.S. PATENT DOCUMENTS 3,258,549 * 6/1966 Stoi ..... 200/16 R
5,049,709 * 9/1991 Prickett et al. ..... 200/527

* cited by examiner

*Primary Examiner*—Shawn Riley
(74) *Attorney, Agent, or Firm*—Robert E. Bushnell, Esq.

(57) ABSTRACT

A power supply apparatus is provided, which includes a power supply section, a switch device having at least two microswitches, and a microcontroller. The switch device further includes an assembly holder, and a printed circuit board accommodating the microswitches thereon, a pushbutton with at least two legs, and elastic member. The microcontroller controls the power supply section in accordance with the states of the microswitches. The microcontroller determines erroneous operation of a pushbutton.

15 Claims, 6 Drawing Sheets

APPARATUS AND METHOD FOR SUPPLYING POWER TO AN ELECTRONIC SYSTEM

CLAIM OF PRIORITY

This application makes reference to, incorporates the same herein, and claims all benefits accruing under 35 U.S.C. §119 from my application ELECTRONIC SYSTEM FOR PREVENTING FAILURE DURING PUSH OPERATION OF POWER SWITCH AND METHOD OF CONTROLLING POWERSWITCH INPUT SIGNAL filed with the Korean Industrial Property Office on Nov. 23, 1999 and there duly assigned Ser. No. 1999-52233.

BACKGROUND OF THE INVENTION

FIELD OF THE INVENTION

The present invention generally relates to an electronic system and, more particularly, to an apparatus and method for supplying power to an electronic system such as a computer display apparatus or a television receiver set.

BACKGROUND OF THE INVENTION

The development of integrated circuits (ICs) has allowed the electronics industry to establish a trend with products that continue growing increasingly more powerful, reliable, functional, compact, user-friendly, and inexpensive. ICs are widely utilized in a variety of electronic systems, e.g., personal computers, television sets, video cameras, video/audio players, mobile phones, etc., as well as in a host of industrial applications such as heating, air-conditioning, and even automotive control, making these systems more reliable and efficient.

A recent trend of electronic system design is to make surfaces be smooth to the touch by leveling switch buttons with a surface of an electronic system housing. For example, ellipsoidal knob-type power switches are popular in the electronics industry.

A typical knob-type power switch device includes only one microswitch that is installed at the center region thereof. The microswitch is arranged in such a manner that a switching element thereof is depressed in the direction of movement of a pushbutton and is actuated by a protrusion member of the pushbutton. So, such a knob-type power switch operates well when the center region of the pushbutton is exactly depressed, but if not, the switch may not operate well.

What is needed is a power switch that is capable of actuating two or more electrical microswitches underneath the power switch button. A controller connected to each of the microswitches will turn the electrical appliance on if just one of said microswitches is actuated when the power switch button is depressed by user manipulation. Therefore, the user does not need to press the exact center of the power switch button to power on an electrical appliance.

SUMMARY OF THE INVENTION

Therefore, an object of the present invention is to provide an apparatus and method for supplying power to an electronic system having a power switch device capable of operating correctly in spite of depressing an edge part of a pushbutton of the switch device.

It is another object of the present invention to provide an apparatus and method for supplying power to an electronic system, which are capable of preventing errors in supplying power to electronic systems.

It is still yet another object to provide an apparatus and a method that turns on an electrical appliance even when the user fails to press exactly the middle of a pushbutton.

It is also another object of the present invention to provide an apparatus and method that ignores actuation of a power switch when the power switch button has been pressed a short time ago.

It is also another object of the present invention to cut off power to an electrical appliance when the electrical appliance was originally turned on when the pushbutton for the power supply is actuated by user manipulation.

According to a preferred aspect of the invention, power supply apparatus includes a power supply section, a microcontroller, and a switch device having a pushbutton and two (or more) microswitches. The microcontroller controls the power supply section in accordance with the states of the microswitches. The microcontroller receives an electrical signal from the microswitches when either one of the microswitches is pressed, and determines erroneous push operation of the pushbutton, such as pushing the pushbutton successively more than one time within a predetermined period of time.

The switch device further includes a printed circuit board accommodating the microswitches thereon, a board supporting member, an elastic member combined with the pushbutton, and an assembly holder for holding the pushbutton. The pushbutton includes a button body, two or more legs attached to the body and corresponding to the microswitches, and at least two locking hooks.

According to another aspect of the invention, a method of controlling power supply to an electronic system is provided. First, it is repeatedly checked whether the either one of the microswitches is pressed. If so, it is then determined whether one of the microswitches has been pressed previously within the predetermined period of time from the moment when the microswitch is presently pressed. If so, the present switch-on is ignored, but if not, it is checked whether an electronic system is in a power-on state. If the electronic system is in the power-on state, power supply to the system is interrupted. But, if the electronic system is not in the power-on state then the system is supplied with power.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
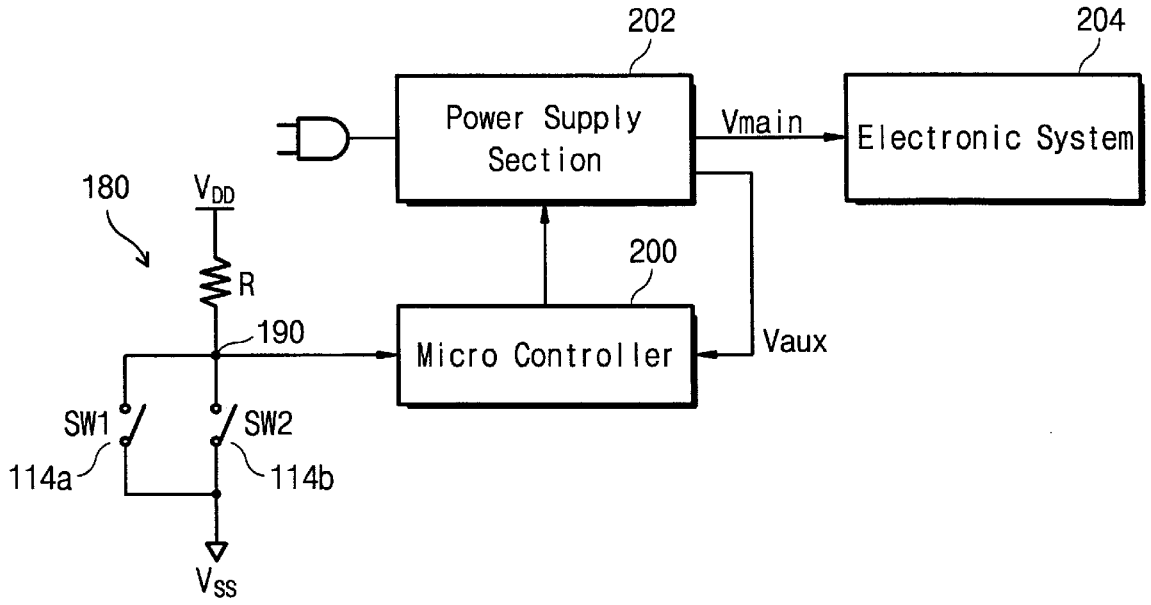
FIG. 1 is a circuit diagram showing an electronic system including a power supply apparatus according to the present invention.

FIG. 1 shows an electronic system equipped with a power supply apparatus according to the present invention. Referring to FIG. 1, the power supply apparatus of the present invention includes a switch circuit 180, a microcontroller 200, and a power supply section 202. The switch circuit 180 is comprised of a resistor R and a microswitch 114*a* which are serially connected between a power supply voltage $V_{DD}$ and a reference voltage $V_{SS}$ lower than the power supply voltage, such as a ground voltage. The switch circuit 180 further includes another mircoswitch 114*b* coupled in parallel to the microswitch 114*a* between the resistor R and the reference voltage VSS. An input of the microcontroller 200 is coupled to the intersection node 190 of the resistor R and the microswitches 114*a* and 114*b*, and an output thereof is fed to a control input of the power supply section 202. It is readily apparent to those skilled in the art that the power supply apparatus may include a power supply indicator circuit consisting of one or more light emitting diodes (LEDs) and their driving circuits for driving the LEDs under the control of the microcontroller 200.

An electronic system 204, such as a computer display monitor, is electrically connected to the power supply section 202. The power supply section 202 supplies power voltages Vmain and Vaux to the electronic system 204 and the microcontroller 200, respectively, using an alternating current (AC) power.

An electrical signal of a low logic level is generated when either one of the microswitches 114*a* and 114*b* is switched on. The microcontroller 200 first determines whether the electrical signal is erroneously generated and then controls the power supply section 202 as the result, which will be described in detail later.

Figure 2:
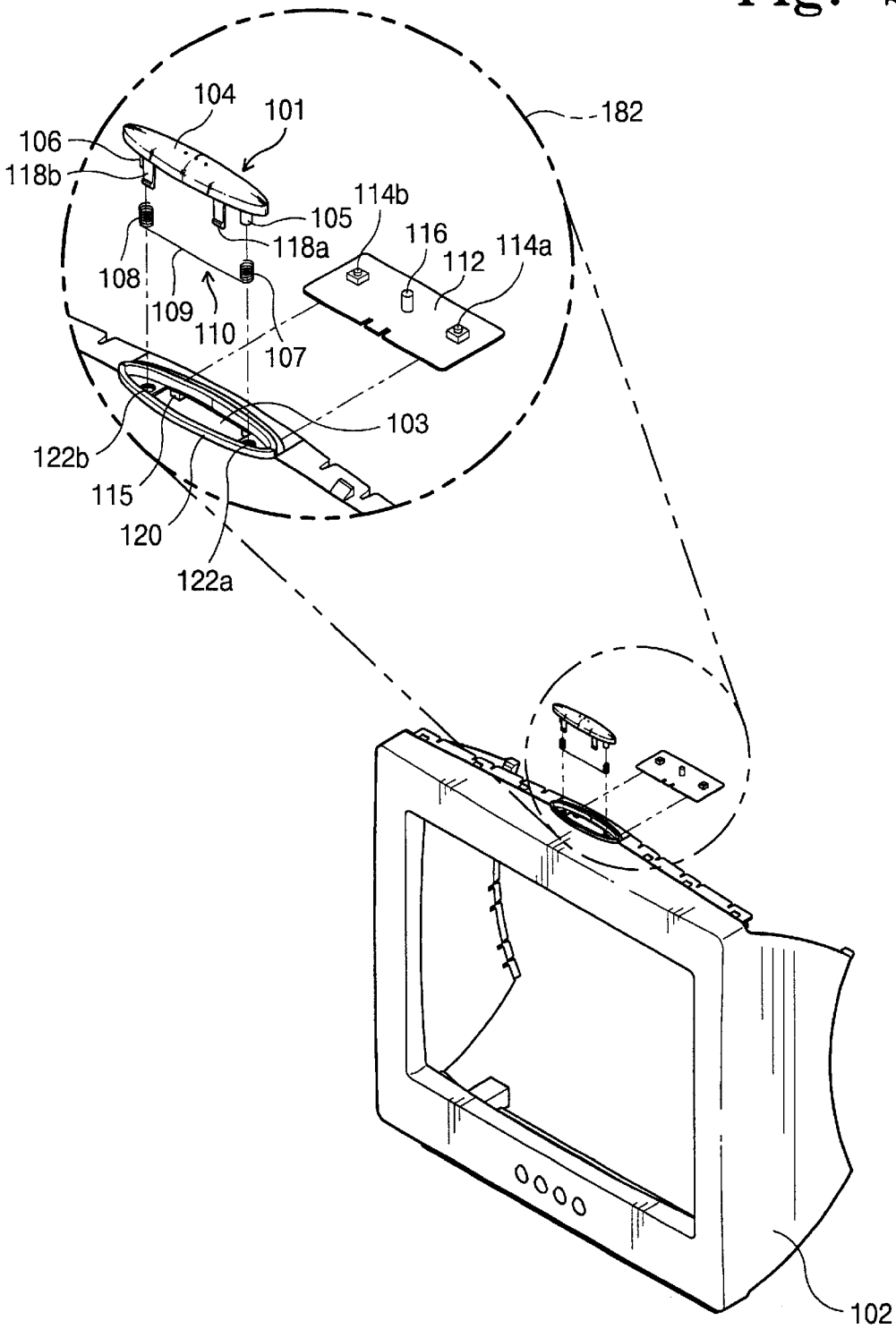
FIG. 2 is an exploded perspective view showing a switch device according to a preferred embodiment of the present invention.

FIG. 2 shows a display apparatus 102, such as a computer display monitor or a television set, including the power supply apparatus with a switch device 182 according to a preferred embodiment of the present invention. Referring to FIG. 2, the switch device 182 comprises a pushbutton 101, an assembly holder 120 having holes 122 and 122' for receiving the pushbutton 101, a printed circuit board (PCB) 112 on which the microswitches 114*a* and 114*b* and a power supply indicator circuit 116 including at least one light emitting diode are mounted. The power supply indicator circuit 116 indicates the status of power supply of the monitor 102 The pushbutton 101 includes a button body 104 that has an outer surface shaped like an ellipsoid and an inner surface having two legs 105 and 106 formed on the both sides of the inner surface and two protrusive locking hooks 118*a* and 118*b* formed between the legs 105 and 106 on the inner surface.

The switch device 182 further includes one united elastic member 110 (or two separate elastic members) combined with the legs 105 and 106. The elastic member 110 enables the button body 104 to move elastically. The locking hooks 118*a* and 118*b* prevent the button body 104 from being separated from the assembly holder 120. The outer surface of the button body 104 is curved and its edges are substantially leveled with a surface of an electronic system housing. The printed circuit board 112 is located beneath the button body 104. The button body 104 is preferably made of either a transparent or a translucent material so that a user may identify the power supply status of the electronic system. Here, although the button body 104 has two legs 105 and 106 formed on both outer sides of its inner surface and the locking hooks 118*a* and 118*b* formed therebetween, however, it is well understood to one skilled in the art that their positions may be exchanged along with the positions of the corresponding microswitches 114*a* and 114*b* on the printed circuit board 112 if necessary.

Figure 3:
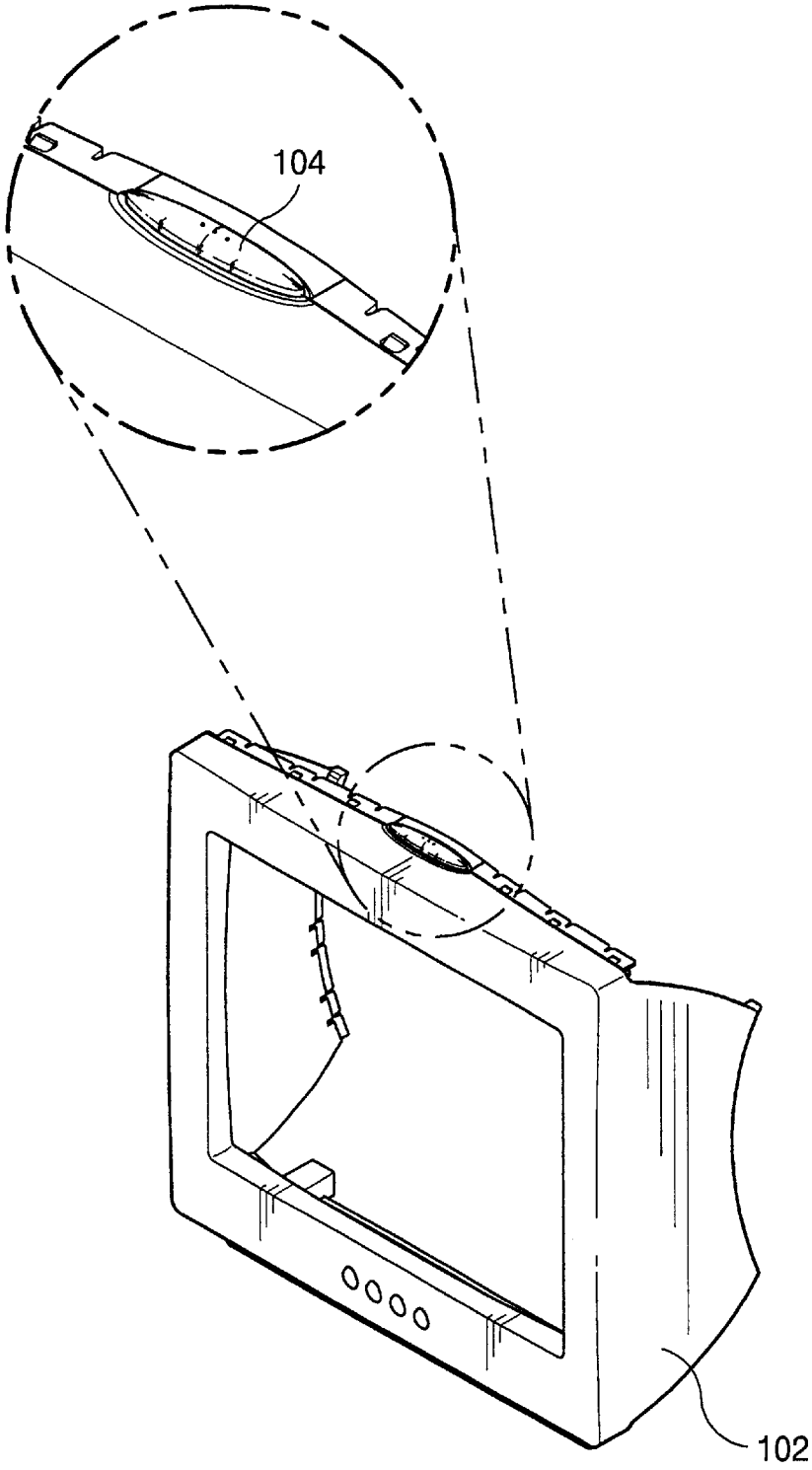
FIG. 3 is a perspective view of the switch device of FIG. 2 after the completion of assembling the switch device.

FIG. 3 is a perspective view of the switch device 182 after the completion of assembling the switch device on the display apparatus 102. Referring to FIG. 3, the ellipsoidal surface of the button body 104 is continuous with upper surface of the display apparatus 102. The ellipsoidal surface of the button body 104 protrudes only a little from the upper housing surface of the display apparatus 102 when the button body 104 is located on the opening formed in the assembly holder 120. Therefore, the upper surface of display apparatus 102 has a smooth and user-friendly appearance. The pushbutton 101 also has such a structure that can generate the electronic signal although either of two ends of the button body 104 is depressed, thus satisfying the recent ergonomic design requirements and providing a convenience to users.

Figure 4A:
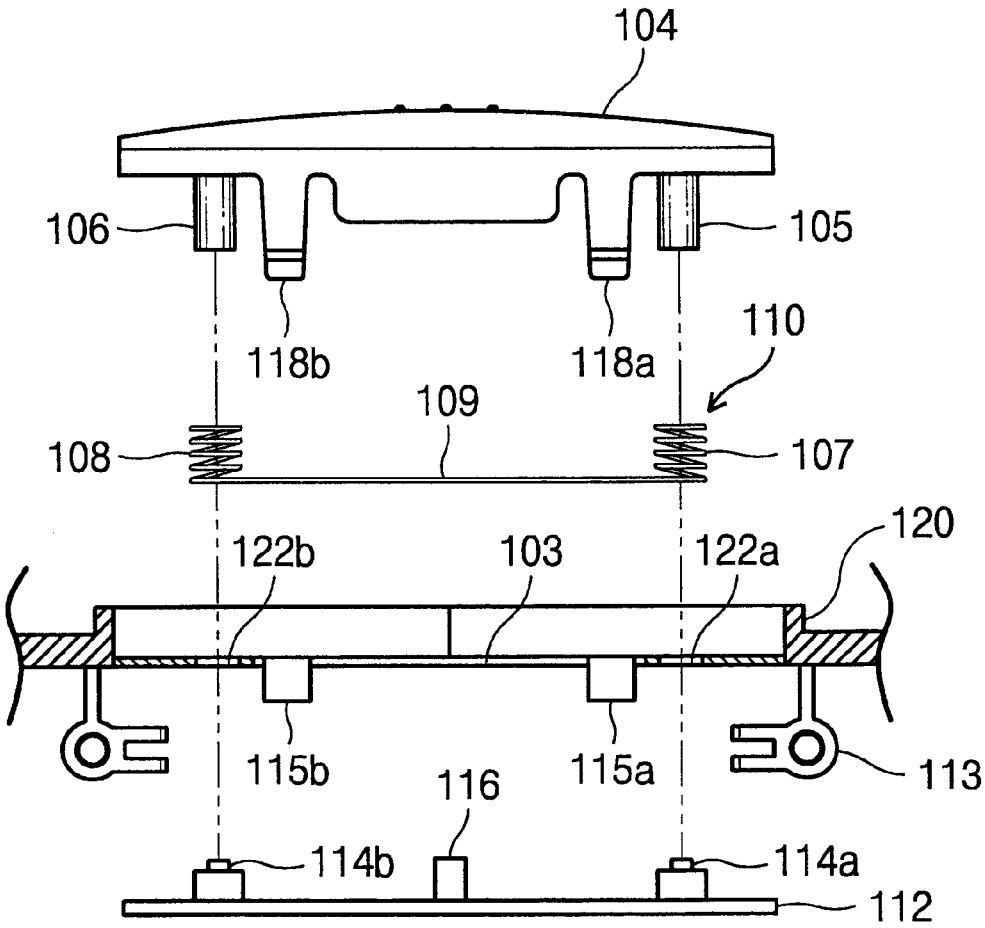
FIG. 4A is an exploded sectional side view showing the switch device of FIG. 2.
Figure 4B:
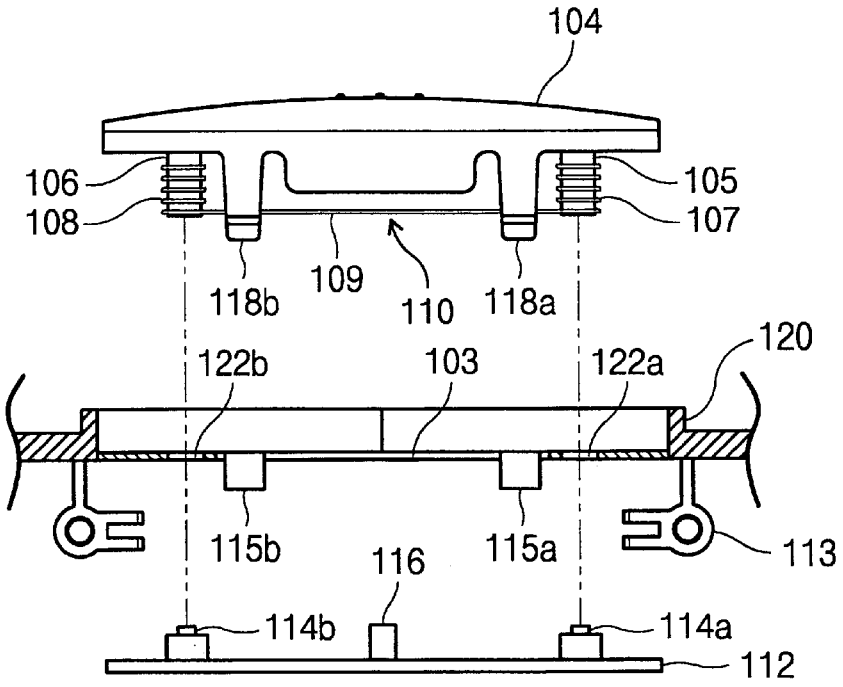
FIG. 4B is a sectional side view showing the switch device of FIG. 4A of which the button body and springs are combined together.
Figure 4C:
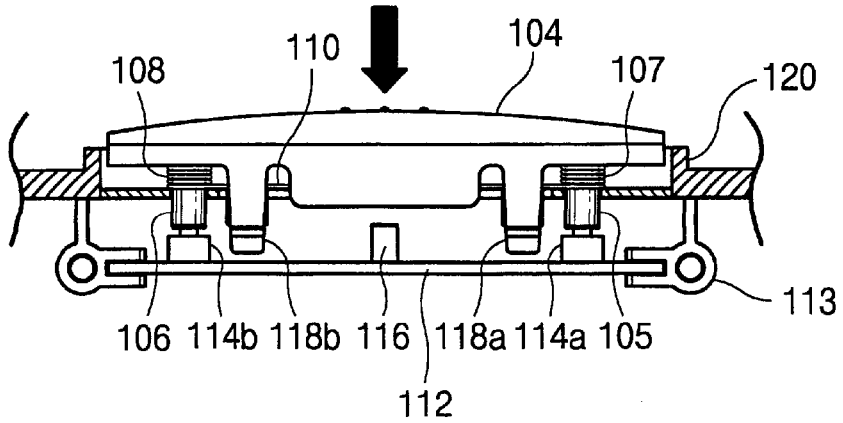
FIG. 4C is a sectional side view showing a pushed state of the switch device of FIG. 4A.

FIG. 4A is an exploded sectional side view showing the detailed construction of the switch device 180, FIG. 4B is a sectional side view showing the switch device 180 in which its button body and springs are combined together, and FIG. 4C is a sectional side view showing a pushed state of the switch device 180. Referring first to FIG. 4A, the elastic member 110 is preferably comprised of a first coil spring 107 and a second coil spring 108 combined with the first and second legs 105 and 106, respectively. Alternatively, the elastic member 110 consists of other types of one or more springs such as plate springs.

To increase assembly efficiency, the two springs 107 and 108 are desirably connected together through a connecting member 109. Such a unified elastic member 110 increases the reliability of the reciprocal operation. The assembly holder 120 has two holes 122*a* and 122*b* formed on its bottom. The holes 122*a* and 122*b* correspond to the legs 105 and 106, respectively. The assembly holder 120 also has two hook acceptors 115*a* and 115*b* formed on the bottom thereof and corresponding to the locking hooks 118*a* and 118*b*, respectively. Bottoms of the hook acceptors 115*a* and 115*b* are opened. The switch device 182 further includes a PCB supporting member 113 that is located inside the housing of the display apparatus 102 so as to sustain the printed circuit board 112 being arranged corresponding to the button body 104.

As shown in FIG. 4B, the springs 107 and 108 of the elastic member 110 are combined with the legs 105 and 106 of the pushbutton 101, respectively. With elastic member 110 combined, the legs 105 and 106 of the pushbutton 101 are arranged with the holes 122*a* and 122*b* of the assembly holder 120, respectively. Thereafter, when the button body 104 is pressed hard, with the printed circuit board mounted on the PCB supporting member 113, as shown in FIG. 4C, the locking hooks 118*a* and 118*b* penetrate the bottom of the hook accepters 115*a* and 115*b*, respectively, and the elastic member 110 is compressed. With no pressure on the button body 104, the button body 104 bounces back due to the elastic force of the compressed elastic member 110. However, when the button body 104 reaches a certain position, it no longer moves upwardly because of the locking mechanism of the hook accepters 115*a* and 115*b* and the locking hooks 118*a* and 118*b* and is preferably settled in a switchable position. According to the above-described structure of the switch device 182, even though a user pushes down any portion (such as an edge part) of the button body 104, at least one of the two microswitches 114*a* and 114*b* can be actuated since at least one of the two legs 105 and 106 moves down, thereby increasing operational correctness of the switch device.

Figure 5:
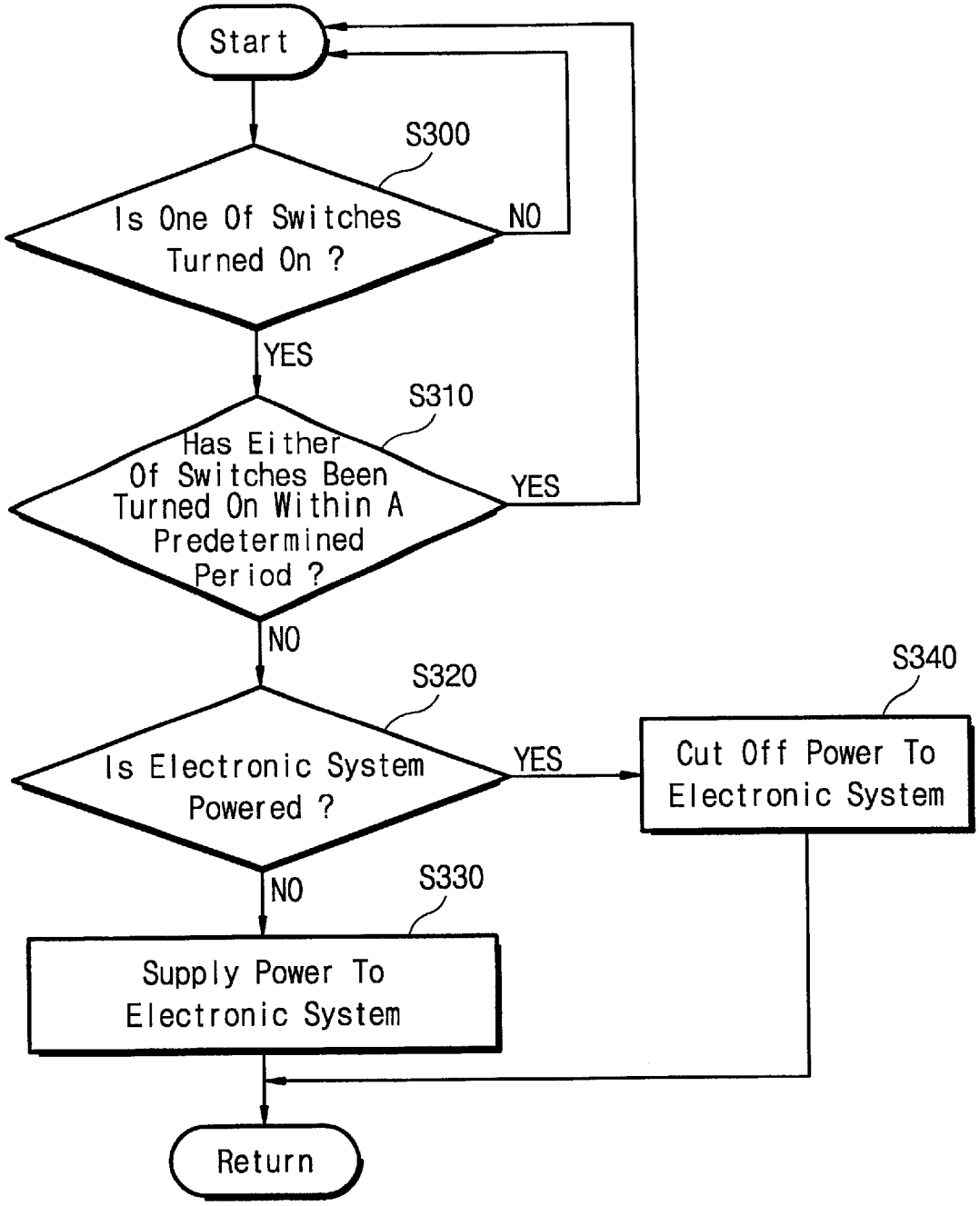
FIG. 5 is a flowchart of a power supply control process according to the present invention.

FIG. 5 is a flowchart of a power supply control process according to the invention. The power control process is carried out by the microcontroller 200 of FIG. 1. The power supply control method of the invention will be described below with reference to FIG. 1 and FIG. 5. At step S300, it is repeatedly checked whether either one of the two microswitches 114*a* and 114*b* is actuated. If 'yes' at step S300, control flow proceeds to step S310 wherein it is determined whether one of the microswitches 114*a* and 114*b* has been pressed previously within a predetermined period of time from the moment when the microswitch is presently pressed (e.g., about 70 milliseconds). If 'yes' at step S310, the present switch-on is ignored and control flow turns back to step S300. If 'no' at step S310 then it is checked whether the electronic system 204 is in a power-on state at step S320. If the electronic system 204 is in the power-on state, the power supply from the power supply section 202 to the system 204 is cut off at step 340. If the electronic system 204 is not in the power-on state then the system 330 is supplied with power from the power supply section 202. According to the above-described invention, it is possible to increase the reliability of controlling power supply to electronic systems.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. An apparatus for controlling power supply to an electronic device, comprising:

a housing;

a manual switch device mounted on the housing and having at least two electrical switches; and a controller for controlling power supply to the electronic device in response to switching operations of at least one of said two electrical switches in response to depressing said manual switch device.

2. The apparatus of claim 1, wherein when said manual switch device is depressed two or more times within a predetermined time period actuating at least one of said two electrical switches each time, said controller acknowledges the first depression of said manual switch device and ignores the other depressions of said manual switch device within said predetermined time period.

3. The apparatus of claim 2, wherein said manual switch device comprises:

a pushbutton having two legs;

an assembly holder formed on a surface of said housing, said assembly holder being perforated by two holes located in operational relationship with said two legs of said pushbutton, said assembly holder for holding said pushbutton;

an elastic member for providing said pushbutton with an elastic force; and a printed circuit board for mounting said two electrical switches thereon, wherein said two electrical switches are electrically coupled to said controller, wherein positions of said two electrical switches are located in operational relationship with said two legs of said pushbutton, and wherein at least one of said two legs pushes at least one of said two electrical switches when said push button is depressed.

4. A method for powering on an electrical device, comprising the steps of:

determining whether or not said electrical device is already turned on;

depressing a pushbutton;

actuating at least one of two microswitches;

determining whether at least one of said two microswitches have been actuated within a predetermined period of time; and supplying power to said electrical device if said electrical device is not already turned on and if one of said two microswitches has not been actuated within a predetermined period of time.

5. The method of claim 4, further comprising the step of cutting off power to said electrical device if at least one of said two microswitches is activated when said electrical device is already turned on.

6. A method for applying power to an electrical appliance, comprising the steps of:

determining whether said electrical appliance is already turned on;

depressing a pushbutton actuating at least one of two microswitches; and cutting off power to said electrical device if said electrical appliance is already turned on.

7. The method of claim 6, further comprising the steps of:

determining whether at least one of said two microswitches has been actuated within a predetermined time period prior to the step of depressing said pushbutton; and leaving the electrical appliance turned on or turned off if at least one of said two microswitches has been actuated within a predetermined time prior to the step of depressing said pushbutton.

8. The method of claim 7, further comprising the step of applying power to said electrical appliance if said electrical appliance is not already powered on when said step of depressing said pushbutton occurs and if neither of said two microswitches have been actuated within a predetermined time prior to said step of depressing said pushbutton.

9. An apparatus for controlling power delivered to an electrical appliance, comprising:

a pushbutton disposed on an exterior of said electrical appliance;

a pair of microswitches disposed underneath said pushbutton;

a controller electrically connected to said pair of microswitches, said controller capable of controlling power delivered to said electrical appliance depending on whether at least one of said pair of microswitches is actuated.

10. The apparatus of claim 9, wherein said pushbutton is ellipsoid in shape.

11. The apparatus of claim 10, wherein each one of said pair of said microswitches is located on opposite sides of said pushbutton underneath said pushbutton.

12. The apparatus of claim 9, wherein an underside of said pushbutton comprises a pair of legs protruding from said pushbutton, said pair of legs being in operational relationship to said pair of microswitches.

13. The apparatus of claim 12, wherein said pair of legs are surrounded by an elastic member biased to keep said pair of legs away from said pair of microswitches absent user manipulation of said pushbutton.

14. The apparatus of claim 12, further comprising an assembly holder disposed between said pushbutton and said pair of microswitches, said assembly holder being perforated by a pair of holes to allow said pair of legs from said pushbutton to pass through to said pair of microswitches.

15. The apparatus of claim 14, wherein said pushbutton has a pair of locking hooks that attach to book acceptors on said assembly holder.

* * * * *